US009067251B2

(12) United States Patent
Carter et al.

(10) Patent No.: US 9,067,251 B2
(45) Date of Patent: Jun. 30, 2015

(54) METHOD OF FORMING AN ARTICLE FROM METAL ALLOY SHEET MATERIAL

(75) Inventors: Jon T. Carter, Farmington, MI (US); Daniel George Valik, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1052 days.

(21) Appl. No.: 13/158,733

(22) Filed: Jun. 13, 2011

(65) Prior Publication Data

US 2012/0312065 A1 Dec. 13, 2012

(51) Int. Cl.
*B21D 22/02* (2006.01)

(52) U.S. Cl.
CPC ..... *B21D 22/022* (2013.01); *B21D 22/02* (2013.01)

(58) Field of Classification Search
CPC ..... B21D 37/16; B21D 22/22; B21D 22/022; B21D 22/02; B21D 22/06; B21D 22/208; B21D 24/04; B21D 25/02; B21D 25/04; B21D 31/005; B21J 1/06; B30B 15/18
USPC ..... 72/342.94, 342.5, 342.6, 347, 350, 72/342.1
See application file for complete search history.

(56) References Cited

U.S. PATENT DOCUMENTS

| | | | | |
|---|---|---|---|---|
| 6,033,499 | A * | 3/2000 | Mitra | 72/342.1 |
| 7,171,838 | B2 * | 2/2007 | Shiokawa | 72/348 |
| 7,260,972 | B2 | 8/2007 | Krajewski | |
| 8,490,455 | B2 * | 7/2013 | Kubo | 72/347 |
| 2008/0173057 | A1 * | 7/2008 | Kruger et al. | 72/342.7 |
| 2011/0100085 | A1 * | 5/2011 | Kubo | 72/350 |

FOREIGN PATENT DOCUMENTS

| | | | |
|---|---|---|---|
| CN | 1923451 | A | 3/2007 |
| CN | 101372024 | A | 2/2009 |
| CN | 101514436 | A | 8/2009 |
| DE | 19923540 | A1 | 12/2000 |

OTHER PUBLICATIONS

Theresa M. Lee, Susan E. Hartfield-Wunsch, Siguang Xu, "Demonstration of the Preform Anneal Process to Form a One-Piece Aluminum Door Inner Panel", SAE International, Apr. 2006, 2006-01-0987.

First Office Action of the State Intellectual Property Office of the People's Republic of China for Chinese Patent Application No. 201210194902.4, mailed on Feb. 28, 2014.

* cited by examiner

*Primary Examiner* — Shelley Self
*Assistant Examiner* — Pradeep C Battula
(74) *Attorney, Agent, or Firm* — Quinn Law Group, PLLC

(57) ABSTRACT

A method of forming an article from a metal alloy sheet material includes stamping the metal alloy sheet material to thereby form a preform having at least one protrusion. The at least one protrusion includes a base portion, a first region having a first thickness and spaced apart from the base portion to thereby have a first maximum height, and a second region interconnecting the base portion and the first region and having a second thickness that is greater than the first thickness. After stamping, the method includes selectively annealing the second region without substantially annealing the first region, and, after selectively annealing, concurrently increasing the first maximum height and substantially equalizing the first thickness and the second thickness to thereby form the article.

16 Claims, 3 Drawing Sheets

METHOD OF FORMING AN ARTICLE FROM METAL ALLOY SHEET MATERIAL

TECHNICAL FIELD

The present disclosure generally relates to methods of forming metal, and more specifically, to methods of forming an article from a metal alloy sheet material.

BACKGROUND

Automotive sheet metal products, such as body and closure panels, may be formed from steel alloy sheet material at ambient temperature by stamping the steel alloy sheet material into complex shapes. Stamping may include gripping the steel alloy sheet material within a stamping tool while a punch forms the steel alloy sheet material according to a shape of a complementary die. Such steel alloy sheet materials are readily formable, and the steel alloy sheet material may be stretched and formed into an article having a complex shape without tearing.

Other metal alloy sheet materials, such as aluminum alloy sheet materials and magnesium alloy sheet materials, may be substituted for steel alloy sheet materials to reduce a weight of the formed article. However, aluminum and magnesium alloy sheet materials are generally less formable than steel alloy sheet materials, and are therefore subject to tearing during forming.

SUMMARY

A method of forming an article from a metal alloy sheet material includes stamping the metal alloy sheet material to thereby form a preform having at least one protrusion. The at least one protrusion includes a base portion, a first region having a first thickness and spaced apart from the base portion to thereby have a first maximum height, and a second region interconnecting the base portion and the first region and having a second thickness that is greater than the first thickness. After stamping, the method includes selectively annealing the second region without substantially annealing the first region. After selectively annealing, the method includes concurrently increasing the first maximum height, and substantially equalizing the first thickness and the second thickness to thereby form the article.

In one embodiment, the metal alloy sheet material is stamped with a stamping tool including a forming surface configured for shaping the metal alloy sheet material. The at least one protrusion has a longitudinal axis, and the first region is spaced apart from the base portion to thereby have the first maximum height along the longitudinal axis. Further, the second region extends from the base portion so as to interconnect the base portion and the first region. The second region has a second maximum height along the longitudinal axis that is less than the first maximum height. Stamping the metal alloy sheet material includes stretching a first area of the metal alloy sheet material along the forming surface to form the corresponding first region of the at least one protrusion, and stretching a second area of the metal alloy sheet material along the forming surface to form the corresponding second region of the at least one protrusion. In addition, the first region has a first hardness, and the second region has a second hardness that is less than the first hardness. After stamping the metal alloy sheet material, the method includes selectively annealing only the second region without substantially annealing the first region to form a workpiece. The method also includes, after selectively annealing, stamping the workpiece to concurrently increase the first maximum height, and substantially equalize the first thickness and the second thickness, to thereby form the article.

In another embodiment, the stamping tool includes a punch having the forming surface, and the metal alloy sheet material is an aluminum alloy in sheet form. Further, selectively annealing includes induction heating the metal alloy sheet material to a temperature of from about 300° C. to about 400° C. for a duration of from about 5 seconds to about 30 seconds. The method also includes, after selectively annealing, quenching the workpiece to about ambient temperature. After quenching the workpiece, the method includes stamping the workpiece to concurrently increase the first maximum height, and substantially equalize the first thickness and the second thickness, to thereby form the article. Concurrent to stamping the workpiece, the method also includes preferentially inducing deformation at the second region so that the article has a substantially uniform thickness of from about 1 mm to about 2 mm at each of the first region and the second region.

The above features and other features and advantages of the present disclosure are readily apparent from the following detailed description of the best modes for carrying out the disclosure when taken in connection with the accompanying drawings.

DETAILED DESCRIPTION

Figure 1A:
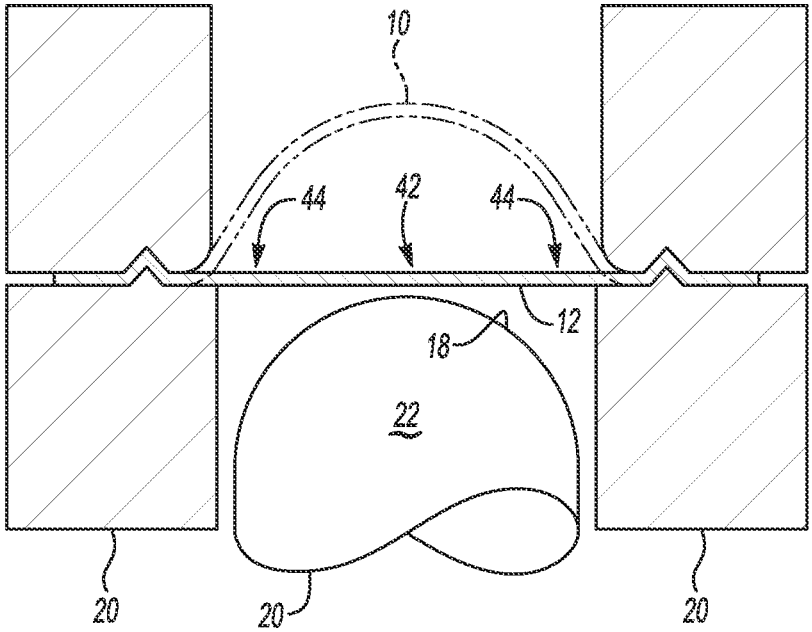
FIG. 1A is a schematic cross-sectional fragmentary illustration of a metal alloy sheet material disposed within a stamping tool in preparation for forming an article from the metal alloy sheet material.

Referring to the Figures, wherein like reference numerals refer to like elements, a method of forming an article 10 from a metal alloy sheet material 12 is described herein. The method may be useful for forming articles 10 having complex shapes from metal alloy sheet materials 12 such as, but not limited to, aluminum alloys and magnesium alloys. As such, the method may be useful for forming articles 10 suitable for automotive applications, such as automotive body and closure panels. However, it is to be appreciated that the method may also be useful for forming articles 10 suitable for non-automotive applications including components for rail and aviation applications.

Figure 1B:
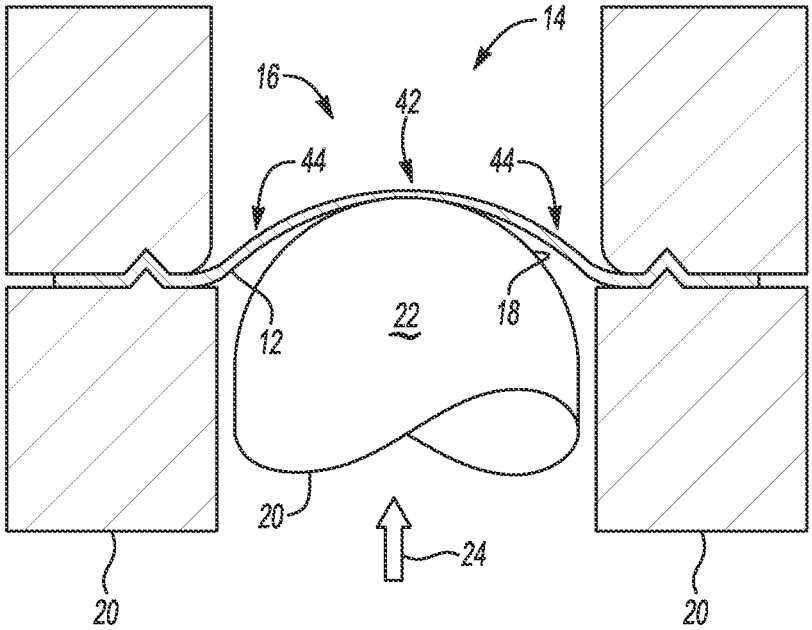
FIG. 1B is a schematic cross-sectional fragmentary illustration of stamping the metal alloy sheet material of FIG. 1A to form a preform.
Figure 1C:
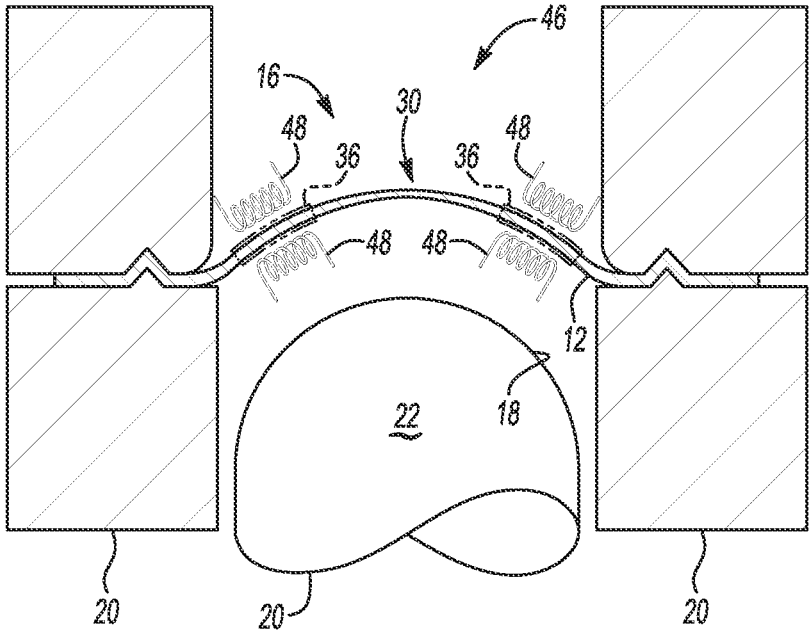
FIG. 1C is a schematic cross-sectional fragmentary illustration of annealing the preform of FIG. 1B to form a workpiece.
Figure 1D:
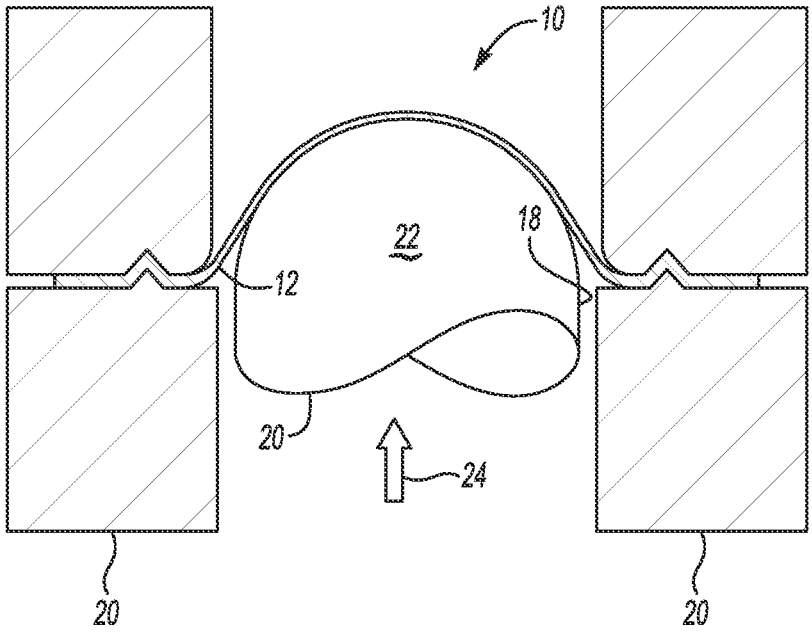
FIG. 1D is a schematic cross-sectional fragmentary illustration of an article formed from the metal alloy sheet material of FIG. 1A.

Referring to FIGS. 1A, 1B, and 1D, the method includes stamping the metal alloy sheet material 12, as set forth in more detail below. The metal alloy sheet material 12 may be any metal alloy in sheet form that is suitable for stamping, and may be selected according to the desired application of the article 10 (FIGS. 1A and 1D) formed by the method.

For example, the metal alloy sheet material 12 may be a 5000 series aluminum alloy in sheet form. By way of a non-limiting example, the metal alloy sheet material 12 may be aluminum alloy AA 5182 and have a composition of about 4.5 parts by weight magnesium, about 0.35 parts by weight manganese, less than or equal to about 0.20 parts by weight silicon, less than or equal to about 0.15 parts by weight copper, less than or equal to about 0.1 part by weight chromium, less than or equal to about 0.25 parts by weight zinc, and the balance aluminum based on 100 parts by weight of the aluminum alloy AA 5182. In another non-limiting example, the metal alloy sheet material 12 may be aluminum alloy AA 5754 and have a composition of about 2.7 parts by weight magnesium, less than or equal to about 0.5 parts by weight manganese, less than or equal to about 0.3 parts by weight chromium, and the balance aluminum based on 100 parts by weight of the aluminum alloy AA 5754.

Alternatively, the metal alloy sheet material 12 may be a 6000 series aluminum in sheet form. For example, the metal alloy sheet material 12 may be aluminum alloy 6111 and have a composition of about 0.75 parts by weight magnesium, about 0.90 parts by weight silicon, about 0.70 parts by weight copper, about 0.30 parts by weight manganese, less than or equal to about 0.10 parts by weight chromium, less than or equal to about 0.15 parts by weight zinc, and the balance aluminum based on 100 parts by weight of the aluminum alloy 6111.

In yet another non-limiting example, the metal alloy sheet material 12 may be a magnesium alloy in sheet form. For example, the metal alloy sheet material 12 may be magnesium alloy AZ31 and have a composition of about 3 parts by weight aluminum, about 1 part by weight zinc, about 0.2 parts by weight manganese, and the balance magnesium based on 100 parts by weight of the magnesium alloy AZ31.

Referring again to FIGS. 1A and 1B, the method includes stamping the metal alloy sheet material 12 to thereby form a preform 14 (FIG. 1B) having at least one protrusion 16 (FIG. 1B). By way of a non-limiting example, stamping may include disposing the metal alloy sheet material 12 in contact with a forming surface 18 configured for shaping the metal alloy sheet material 12, and stretching the metal alloy sheet material 12 along the forming surface 18 to form the at least one protrusion 16. In one variation, the metal alloy sheet material 12 may be stamped with a stamping tool 20 including the forming surface 18.

Figure 3:
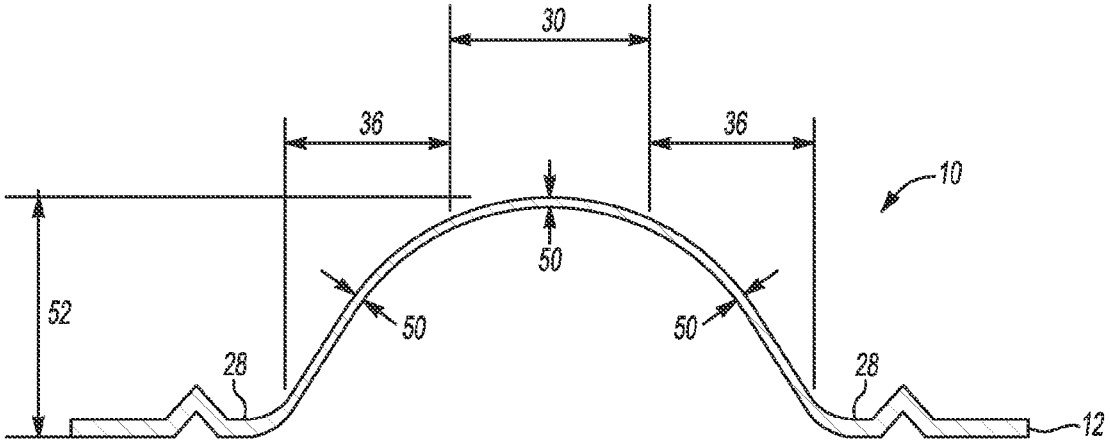
FIG. 3 is a schematic cross-sectional illustration of the article of FIG. 1D.

For example, with continued reference to FIGS. 1A and 1B, the metal alloy sheet material 12 may be stamped with the stamping tool 20 including a punch 22 having the forming surface 18. More specifically, the punch 22 has the forming surface 18 configured for shaping the metal alloy sheet material 12 according to a desired geometry of the article 10 (FIG. 3). During stamping, the metal alloy sheet material 12 may be clamped and/or gripped by the stamping tool 20, as shown in FIGS. 1A-1D. The punch 22 may translate in the direction of arrows 24 (FIGS. 1B and 1D) to contact the metal alloy sheet material 12.

For the method, as described with reference to FIGS. 1B and 1C, the metal alloy sheet material 12 is stamped, e.g., with the stamping tool 20, to form the preform 14 having the at least one protrusion 16. That is, stamping the metal alloy sheet material 12 may include disposing the metal alloy sheet material 12 in contact with the forming surface 18 and stretching the metal alloy sheet material 12 along the forming surface 18 to form the at least one protrusion 16. It is to be appreciated that the preform 14 (FIG. 1B) has an initial shape of the eventual article 10 (FIG. 3), but does not have the final shape of the article 10.

Figure 2:
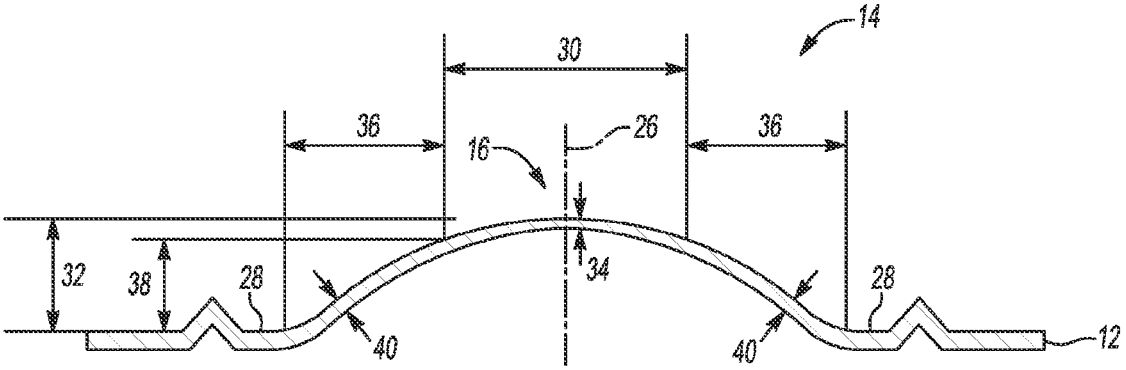
FIG. 2 is a schematic cross-sectional illustration of the preform of FIG. 1B.

As best shown in FIG. 2, the at least one protrusion 16 may have a longitudinal axis 26. Further, the at least one protrusion 16 includes a base portion 28, and a first region 30 spaced apart from the base portion 28 to thereby have a first maximum height 32. That is, the first region 30 may be spaced apart from the base portion 28 to thereby have the first maximum height 32 along the longitudinal axis 26. For example, as shown in FIG. 2, the at least one protrusion 16 may curve to an apex within the first region 30 having the first maximum height 32. As such, the first region 30 may form a top portion of the at least one protrusion 16. The first region 30 also has a first thickness 34, as shown in FIG. 2.

In addition, with continued reference to FIG. 2, the at least one protrusion 16 has a second region 36 extending from the base portion 28 so as to interconnect the base portion 28 and the first region 30. The second region 36 has a second maximum height 38 along the longitudinal axis 26 that is less than the first maximum height 32. That is, the second region 36 extends from the base portion 28 between the base portion 28 and the first region 30 such that the second maximum height 38 is less than the first maximum height 32. Therefore, as shown in FIG. 2, the second region 36 may form the sides of the at least one protrusion 16. In addition, the second region has a second thickness 40 that is greater than the first thickness 34.

Referring to FIGS. 1A and 1B, stamping may further include stretching a first area 42 of the metal alloy sheet material 12 in contact with the forming surface 18 to form the corresponding first region 30 (FIG. 2) of the at least one protrusion 16. That is, stamping the metal alloy sheet material 12 may include stretching the first area 42 of the metal alloy sheet material 12 along the forming surface 18 to form the corresponding first region 30 of the at least one protrusion 16.

With continued reference to FIGS. 1A and 1B, stamping may further include stretching a second area 44 of the metal alloy sheet material 12 in contact with the forming surface 18 to form the corresponding second region 36 (FIG. 2) of the at least one protrusion 16. It is to be appreciated that the second area 44 may also stretch before contacting the forming surface 18. However, stamping the metal alloy sheet material 12 may include stretching the second area 44 of the metal alloy sheet material 12 along the forming surface 18 to form the corresponding second region 36 of the at least one protrusion 16. As the forming surface 18 of the punch 22 contacts and stretches the metal alloy sheet material 12, the first region 30 (FIG. 2) may stretch more than the second region 36 (FIG. 2). As such, the second region 36 may be thicker than the first region 30.

In addition, with continued reference to FIG. 2, the first region 30 may have a first hardness and the second region 36 may have a second hardness that is less than the first hardness. That is, the method may include, concurrent to stamping, straining the first region 30 to a first strain level such that the first region 30 has the first hardness. Similarly, the method may include, concurrent to stamping, straining the second region 36 to a second strain level that is less than the first strain level such that the second region 36 has the second hardness. Stated differently, the method may include work-hardening the first region 30 and the second region 36, i.e., stretching the respective first and second areas 42, 44 (FIGS. 1A and 1B) of the metal alloy sheet material 12 along the forming surface 18 (FIGS. 1A and 1B) of the punch 22 (FIGS. 1A and 1B). As the metal alloy sheet material 12 is stretched along the forming surface 18 during stamping, the first region 30 (FIG. 2) may be stretched and work-hardened to a greater degree than the second region 36 (FIG. 2) so that the first hardness is greater than the second hardness. Stated differently, the first strain level may be greater than the second strain level so that the first region 30 is harder than the second region 36.

Referring now to FIG. 1C, after stamping the metal alloy sheet material 12, the method includes selectively annealing the second region 36 without substantially annealing the first region 30. As used herein, the terminology "annealing" refers to heat treating the metal alloy sheet material 12 to a pre-determined temperature, maintaining the temperature, and subsequently cooling the metal alloy sheet material 12. For example, the pre-determined temperature may be above the recrystallization temperature of the work-hardened metal alloy sheet material 12. Selectively annealing refers to localized annealing, i.e., annealing only the second region 36 without substantially annealing the first region 30, to thereby form a workpiece 46. As such, the second region 36 may be selectively annealed in any manner suitable for heating only a portion of the metal alloy sheet material 12. Selectively annealing may include heating the second region 36 to a temperature of from about 250° C. to about 550° C. The temperature may be selected, for example, according to the alloy composition of the metal alloy sheet material 12 and an amount of work-hardening. In one non-limiting example, selectively annealing may include induction heating the second region 36 to a temperature of from about 300° C. to about 500° C. for a duration of from about 5 seconds to about 1 minute. That is, selectively annealing may include induction heating the metal alloy sheet material 12 with a plurality of localized heating elements 48 (FIG. 1C) to a temperature of from about 300° C. to about 400° C. for a duration of from about 5 seconds to about 30 seconds. Further, although the plurality of localized heating elements 48 is shown disposed adjacent the metal alloy sheet material 12 within the stamping tool 20 in FIG. 1C, it is to be appreciated that the localized heating elements 48 may be positioned external (not shown) to the stamping tool 20.

Without intending to be limited by theory and described with reference to FIG. 2, since the second region 36 is thicker and softer than the first region 30 after stamping to form the preform 14 as set forth above, selectively annealing the second region 36 without substantially annealing the first region 30 softens the second region 36 without softening the first region 30. That is, selectively annealing the second region 36 relieves internal stresses within the metal alloy sheet material 12 generated during stamping, and improves the formability of the second region 36 as compared to the first region 30. Therefore, selectively annealing the second region 36 further reduces the second hardness.

After selectively annealing, the method may further include quenching the workpiece 46 (FIG. 1C) to about ambient temperature. That is, the workpiece 46 may be cooled after selectively annealing the second region 36 (FIG. 1C). Such quenching may protect the stamping tool 20 from heat generated during selectively annealing.

Referring now to FIGS. 1D, 2, and 3, after selectively annealing and optional quenching the workpiece 46 (FIG. 1C), the method further includes concurrently increasing the first maximum height 32 (FIG. 2), and substantially equalizing the first thickness 34 (FIG. 2) and the second thickness 40 (FIG. 2) to thereby form the article 10 (FIG. 3). That is, referring to FIG. 3, the article 10 may have a substantially uniform thickness 50 at each of the first region 30 and the second region 36. Therefore, the base portion 28 may be thicker than each of the first region 30 and the second region 36, as shown in FIG. 3. In particular, concurrently increasing and substantially equalizing may include stamping the workpiece 46 to form the article 10. That is, referring to FIGS. 1C, 1D, 2, and 3, the workpiece 46 (FIG. 1C) may be stretched along the forming surface 18 (FIG. 1D) of the stamping tool 20 (FIG. 1D) to further increase the first maximum height 32 (FIG. 2) of the at least one protrusion 16 and concurrently substantially equalize the first thickness 34 (FIG. 2) and the second thickness 40 (FIG. 2). Stamping the workpiece 46 may form the article 10 (FIG. 3) having a substantially uniform thickness 50 (FIG. 3) at each of the first region 30 and the second region 36 of from about 0.75 mm to about 2.25 mm.

With continued reference to FIGS. 1C and 1D, since the second region 36 (FIG. 1C) is thicker than the first region 30 (FIG. 1C), and since the second region 36 is softened during selectively annealing, the method may include, after selectively annealing, preferentially inducing deformation at the second region 36. That is, the aforementioned equalization of the first thickness 34 and the second thickness 40 may be accomplished by preferentially thinning the second region 36 comparatively more than the first region 30. In particular, since selectively annealing softens the second region 36 as compared to the first region 30, the method may preferentially induce deformation, e.g., stretching of the second region 36 along the forming surface 18 (FIG. 1D), during stamping. Conversely, the method may deter deformation at the first region 30. Therefore, referring to FIG. 2, the first maximum height 32 of the at least one protrusion 16 increases, and the first thickness 34 and second thickness 40 substantially equalize, so that the article 10 (FIG. 3) is taller than the workpiece 46 (FIG. 1C) and has the substantially uniform thickness 50 (FIG. 3) at each of the first region 30 and the second region 36. That is, in one non-limiting example, the method includes stamping the workpiece 46 (FIG. 1C) to concurrently increase the first maximum height 32 (FIG. 2), and substantially equalize the first thickness 34 (FIG. 2) and the second thickness 40 (FIG. 2) to thereby form the article 10 (FIG. 3). In another non-limiting example, the method includes preferentially inducing deformation at the second region 36 (FIG. 2) so that the article 10 (FIG. 3) has a substantially uniform thickness 50 (FIG. 3) of from about 1 mm to about 2 mm, e.g., about 1.5 mm, at each of the first region 30 and the second region 36.

Therefore, the method maximizes the formability of the metal alloy sheet material 12. In particular, the method forms articles 10 having increased shape complexity and allows for protrusions 16 having an increased total maximum height 52 (FIG. 3) without splitting. That is, the total maximum height 52 of the article 10 is greater than the first maximum height 32 (FIG. 2) of the preform 14 (FIG. 2). In addition, the total maximum height 52 of the article 10 is greater than a total maximum height (not shown) of comparative articles (not shown) formed, for example, without any annealing, and/or without selectively annealing the second region 36, i.e., annealing the entire comparative preform (not shown) and/or annealing only the first region 30. Further, the method forms articles 10 having excellent uniformity of thickness 50 at the first region 30 and the second region 36. That is, as shown in FIG. 3, the formed article 10 has the substantially uniform thickness 50 at each of the first region 30 and the second region 36. In addition, the method requires comparatively lower heating energy during selective annealing and is therefore cost-effective as compared to a comparative method including annealing the entire comparative preform (not shown). As such, the method may be useful for forming complex articles 10 such as decklid and liftgate panels for automotive vehicles.

While the best modes for carrying out the disclosure have been described in detail, those familiar with the art to which this disclosure relates will recognize various alternative designs and embodiments for practicing the disclosure within the scope of the appended claims.

The invention claimed is:

1. A method of forming an article from a metal alloy sheet material, the method comprising:

stamping the metal alloy sheet material to thereby form a preform having at least one protrusion;

wherein the at least one protrusion includes a base portion, a first region having a first thickness and spaced apart from the base portion to thereby have a first maximum height, and a second region interconnecting the base portion and the first region and having a second thickness that is greater than the first thickness;

wherein the first region has a first hardness and the second region has a second hardness that is less than the first hardness;

concurrent to stamping:

straining the first region to a first strain level such that the first region has the first hardness; and straining the second region to a second strain level that is less than the first strain level such that the second region has the second hardness;

after stamping, selectively annealing the second region without substantially annealing the first region; and after selectively annealing, concurrently increasing the first maximum height, and substantially equalizing the first thickness and the second thickness to thereby form the article.

2. The method of claim 1, further including, after selectively annealing, preferentially inducing comparatively more deformation at the second region than at the first region.

3. The method of claim 1, wherein stamping includes disposing the metal alloy sheet material in contact with a forming surface configured for shaping the metal alloy sheet material, and stretching the metal alloy sheet material along the forming surface to form the at least one protrusion.

4. The method of claim 3, wherein stamping further includes stretching a first area of the metal alloy sheet material in contact with the forming surface to form the corresponding first region of the at least one protrusion.

5. The method of claim 4, wherein stamping further includes stretching a second area of the metal alloy sheet material in contact with the forming surface to form the corresponding second region of the at least one protrusion.

6. The method of claim 1, wherein selectively annealing includes heating the second region to a temperature of from 250° C. to 550° C.

7. The method of claim 6, wherein selectively annealing includes induction heating the second region to a temperature of from 300° C. to 500° C. for a duration of from 5 seconds to 1 minute.

8. The method of claim 1, wherein selectively annealing forms a workpiece, and further wherein concurrently increasing and substantially equalizing the first thickness and the second thickness includes stamping the workpiece.

9. The method of claim 8, further including, after selectively annealing, quenching the workpiece to ambient temperature.

10. The method of claim 1, wherein the article has a substantially uniform thickness at each of the first region and the second region.

11. The method of claim 1, wherein the metal alloy sheet material is a 5000 series aluminum alloy in sheet form.

12. The method of claim 1, wherein the metal alloy sheet material is a 6000 series aluminum alloy in sheet form.

13. The method of claim 1, wherein the metal alloy sheet material is a magnesium alloy in sheet form.

14. A method of forming an article from a metal alloy sheet material, the method comprising:

stamping the metal alloy sheet material to thereby form a preform having at least one protrusion, wherein the metal alloy sheet material is stamped with a stamping tool including a forming surface configured for shaping the metal alloy sheet material;

wherein the at least one protrusion has a longitudinal axis and includes;

a base portion;

a first region spaced apart from the base portion to thereby have a first maximum height along the longitudinal axis; and a second region extending from the base portion so as to interconnect the base portion and the first region, and having a second maximum height along the longitudinal axis that is less than the first maximum height;

wherein stamping the metal alloy sheet material includes stretching a first area of the metal alloy sheet material along the forming surface to form the corresponding first region of the at least one protrusion, and stretching a second area of the metal alloy sheet material along the forming surface to form the corresponding second region of the at least one protrusion;

wherein the first region has a first thickness and a first hardness, and wherein the second region has a second thickness that is greater than the first thickness, and a second hardness that is less than the first hardness;

concurrent to stamping:

straining the first region to a first strain level such that the first region has the first hardness; and straining the second region to a second strain level that is less than the first strain level such that the second region has the second hardness;

after stamping the metal alloy sheet material, selectively annealing only the second region without substantially annealing the first region to form a workpiece; and after selectively annealing, stamping the workpiece to concurrently increase the first maximum height, and substantially equalize the first thickness and the second thickness, to thereby form the article.

15. The method of claim 14, wherein stamping the workpiece forms the article having a substantially uniform thickness of from 0.75 mm to 2.25 mm at each of the first region and the second region.

16. A method of forming an article from a metal alloy sheet material, the method comprising:

stamping the metal alloy sheet material to thereby form a preform having at least one protrusion, wherein the metal alloy sheet material is stamped with a stamping tool including a punch having a forming surface configured for shaping the metal alloy sheet material;

wherein the at least one protrusion has a longitudinal axis and includes;

a base portion;

a first region spaced apart from the base portion to thereby have a first maximum height along the longitudinal axis; and a second region extending from the base portion so as to interconnect the base portion and the first region, and having a second maximum height along the longitudinal axis that is less than the first maximum height;

wherein the metal alloy sheet material is an aluminum alloy in sheet form;

wherein stamping the metal alloy sheet material includes stretching a first area of the metal alloy sheet material along the forming surface to form the corresponding first region of the at least one protrusion, and stretching a second area of the metal alloy sheet material along the forming surface to form the corresponding second region of the at least one protrusion;

wherein the first region has a first thickness and a first hardness, and wherein the second region has a second thickness that is greater than the first thickness, and a second hardness that is less than the first hardness;

concurrent to stamping:

straining the first region to a first strain level such that the first region has the first hardness; and straining the second region to a second strain level that is less than the first strain level such that the second region has the second hardness;

after stamping the metal alloy sheet material, selectively annealing only the second region without substantially annealing the first region to form a workpiece, wherein selectively annealing includes induction heating the metal alloy sheet material to a temperature of from 300° C. to 400° C. for a duration of from 5 seconds to 30 seconds;

after selectively annealing, quenching the workpiece to ambient temperature;

after quenching the workpiece, stamping the workpiece to concurrently increase the first maximum height, and substantially equalize the first thickness and the second thickness, to thereby form the article; and concurrent to stamping the workpiece, preferentially inducing comparatively more deformation at the second region than at the first region so that the article has a substantially uniform thickness of from 1 mm to 2 mm at each of the first region and the second region.

* * * * *